US007213660B2

(12) United States Patent
Martin

(10) Patent No.: US 7,213,660 B2
(45) Date of Patent: May 8, 2007

(54) WASHPIPE SEAL

(75) Inventor: Kevin J. Martin, Doylestown, PA (US)

(73) Assignee: SKF USA Inc., Kulpsville, PA (US)

( * ) Notice: Subject to any disclaimer, the term of this patent is extended or adjusted under 35 U.S.C. 154(b) by 0 days.

(21) Appl. No.: 11/427,196

(22) Filed: Jun. 28, 2006

(65) Prior Publication Data

US 2007/0007044 A1 Jan. 11, 2007

Related U.S. Application Data

(63) Continuation-in-part of application No. 11/174,687, filed on Jul. 5, 2005.

(51) Int. Cl.
*E21B 21/06* (2006.01)
*E21B 21/00* (2006.01)

(52) U.S. Cl. ..... 175/207; 175/214; 166/78.1; 277/420

(58) Field of Classification Search ..... 166/78.1, 166/84.3, 88.4; 175/207, 214; 277/412, 277/417, 420, 427, 430
See application file for complete search history.

(56) References Cited

U.S. PATENT DOCUMENTS 3,426,855 A * 2/1969 Koot et al. ..... 173/197
3,472,518 A 10/1969 Harlan
3,638,742 A 2/1972 Wallace
3,749,456 A 7/1973 Whitaker
4,022,479 A 5/1977 Orlowski
4,102,418 A 7/1978 Kammerer, Jr.
4,513,816 A 4/1985 Hubert
4,557,489 A 12/1985 Wentworth
5,330,201 A 7/1994 Hart
6,007,105 A 12/1999 Dietle et al.
6,325,382 B1 12/2001 Iwamoto et al.
6,371,487 B1 4/2002 Cimbura, Sr.
6,659,227 B2 12/2003 Yamamoto et al.
6,834,860 B2 12/2004 Rinaldo
6,923,254 B2 * 8/2005 Morrow et al. ..... 166/88.4
2004/0080113 A1 * 4/2004 Linden et al. ..... 277/412
2004/0175065 A1 9/2004 Nguyen
2004/0207159 A1 10/2004 Morrow et al.
2004/0245727 A1 12/2004 Bunn
2005/0206090 A1 * 9/2005 Bunn ..... 277/549
2006/0042789 A1 * 3/2006 Kubala ..... 166/88.4

* cited by examiner

*Primary Examiner*—David Bagnell
*Assistant Examiner*—Nicole A Coy
(74) *Attorney, Agent, or Firm*—Vedder Price Kaufman & Kammholz

(57) ABSTRACT

A controlled leakage seal assembly having a first stationary portion adapted to be connected in substantially fluid-tight relation to a source of drilling fluid and a second portion adapted to be connected in substantially fluid-tight relation to a rotary portion including a washpipe. The seal includes a first housing and a stack of radially inwardly extending, spaced apart annular stators, and a second seal housing and stack of spaced apart radially outwardly extending annular rotors interleaved with one another. The seal assembly, a cartridge, permits the first and second housings to rotate relative to each other in substantially fluid-tight relation except for the drilling fluid entering an outlet region at greatly reduced pressure. In a preferred embodiment, the seal is held by a sleeve that permits the cartridge to be removed and replaced while the fluid connections to the sleeve remains.

18 Claims, 9 Drawing Sheets

WASHPIPE SEAL

BACKGROUND OF THE INVENTION

This is a continuation-in-part of prior application Ser. No. 11/174,687, filed Jul. 5, 2005, which is hereby incorporated herein by reference in its entirety.

The present invention relates generally to so-called washpipe seals and more particularly, to a washpipe seal which is adapted to permit controlled leakage of a small portion of high pressure drilling fluid which largely passes into the so-called washpipe and into the drill string which is attached thereto. In the oil field industry particularly, a so-called swivel assembly incorporates a seal at the washpipe to confine the major portion of the drilling fluid to the washpipe. This drilling fluid is sometimes colloquially referred to as "drilling mud" or simply "mud."

In the drilling system, there are high pressure abrasive fluids which are sent down to the bore hole through the washpipe and the drill string, and ultimately to the drill motor which is held at the bottom of the drill string. This abrasive fluid is supplied to the motor which drives the cutting tools under very high pressure, e.g. 5,000 PSI to 7,500 PSI or even 10,000 PSI or more. A seal is necessary between the non-rotary upper connection assembly and the rotary lower connection assembly to prevent undue leakage of this drilling fluid to the outside. As a rule, the drilling fluid leakage is taken from the vicinity of the washpipe back to a remote container where it is again picked up and supplied to the drill string. The joint in question is between the upper connection assembly, which includes a housing for the stator assembly and the lower connection assembly which includes the rotor assembly and which is affixed to and rotates with the drill string. The rotor and housing are sometimes collectively referred to as a "cartridge."

According to one embodiment of the invention, the leakage of the drilling fluid, which is operated from 5,000 PSI up to perhaps 10,000 PSI or more for example, is led through a labyrinth between alternating rotor/stator discs, which preferably include lands and grooves in each rotor/stator disc. As the flow moves along between each rotor/stator it moves a radial distance about equal to the radial extent of each stator and rotor and an axial distance approximately equal to the thickness of each rotor and stator unit.

As a consequence of passing through this labyrinth of discs, the drilling fluid in one embodiment gradually is subject to a reduced pressure and ultimately achieves a low pressure and passes to an outlet, where it is led via a conduit back to the source of drilling fluid. Here, the drilling fluid passes back into the washpipe and undergoes a repetition of the cycle. According to the invention, only a very small portion of the drilling fluid escapes through the labyrinth seal compared to the portion of drilling fluid directed down the drill string, and the seal of the invention may thus be considered a controlled leakage seal.

In another embodiment, the force of the controlled leakage drilling fluid is opposed by grease within the labyrinth, whereby the grease fills most or all of the labyrinth and is present at what, in another embodiment, would be the inlet for the drilling fluid. The grease thus passes backwardly through the labyrinth of rotors and stators up to the approximate point of entry of the drilling fluid. In this embodiment, the drilling fluid is sealed at the top rather than at the bottom of the labyrinth, and the grease extends back and totally fills the labyrinth defined by the rotors and stators.

In either of these embodiments, it is possible and in fact probable that the cartridge, comprising the housing, or the fixed portion of the cartridges, the rotor and its included portions will need to be replaced or serviced, often fairly frequently, during the continuation of their operation. In the past the manner in which the fixed housing and the rotor have been hooked up is such that, in order to maintain it or replace parts, the system would have to be disabled, and the parts taken apart by unscrewing them on one or both sides. Thereafter, removing them would be extremely difficult because of the structure surrounding the washpipe unit. In other words, a structure that could permit the ready removal of the housing and rotor, sometimes collectively called the cartridge, and permit replacement of them with very little or no difficulty, would be highly desirable. This is done by providing a master coupling with at least one opening and preferably by attaching the cartridges with flanges which are clamped together and easily taken apart.

One of the features of the present invention is that the stator discs and the rotor discs are interleaved and arranged with very small clearance spaces between them. Consequently, in the stator unit there are a plurality of spacers, with a stator disc between each set of spacers. Also, there are a plurality of rotors, each one in turn separated by spacers. Consequently, there is an alternating stack of interleaved rotors and spacers which maintain the desired clearance. Each disc, in one embodiment, has a plurality of grooves of perhaps 0.005 to 0.050 inches, as well as a large plurality of lands which extend into the grooves, perhaps 0.005 to 0.040 inches by way of example. Each of the stator spacers and the rotor spacers is preferably held snugly in the desired configuration of a stack by Belleville washers or other similar units, and each of the spacers includes an O-ring or similar packing to ensure the correct alignment and spacing and to insure that there is no leakage through a secondary route. Thus, the spacers are held snugly in place by Belleville washer and the o-rings under compression. In addition, the rotor disks and the stators are held onto the inner and outer housings by keyways having locking pins associated with them, as will appear.

At the top of one embodiment of the novel rotor/stator assembly of the invention, is an annular space between sections of the housing and above the labyrinth. The drilling fluid pressure at this point is perhaps 5,000 to 10,000 PSI, but by reason of passing through the extended labyrinth with perhaps 16 to 20 reversals of radial direction and 16 to 20 axial movements as the drilling fluid moves along a tortuous path, the pressure confining the axial fluid gradually lowers until the fluid reaches the outlet, where it is under relatively low pressure and relatively low flow.

In one preferred embodiment, there is a flow meter in series relation with the drilling fluid escaping from the outlet. In this way, if there is an unexpected or sudden increase in flow, indicative of failure, steps may be taken to promptly rectify any malfunction.

In one embodiment of the prior art, there have been a series of seals, each seeing the highest pressure, and these seals would then fail, one at a time, until there remained only the final seal. This solution was not satisfactory, especially because of a projected seal life of only 50 to 300 hours. The present invention overcomes the difficulties with such seal designs by allowing the pressure to gradually bleed off rather than completely fail in a series of steps, each of which would see all of the pressure.

Because the fluid to be sealed is highly abrasive, the washpipe and the housing are preferably made from an oil field grade of steel and the rotor and stator its associated parts are made from tungsten carbide or other wear-resistant alloys, or other materials with wear-resistant coatings which are also used to provide radial and thrust bearings where the washpipe meets the upper housing. Such parts could also be made from ceramics or other like material. These bushings or bearings are greased through one or more fittings and grease passages which are provided for that purpose.

A known type of seal or packing is used between the lowermost portion of the washpipe and the stator and rotor housings, but this seal or packing sees only the reduced or lowermost pressure which is sensed at the outlet for the drilling fluid and accordingly, such seal is not exposed to high pressure in use.

It is therefore an object of the present invention to provide a new and improved seal for washpipes and similar applications, in oil fields and elsewhere.

A further object of the invention is to provide a washpipe seal wherein the high pressure drilling fluid moves gradually from a region of very high pressure, to a low outlet pressure from where it preferably is returned to the storage point for reuse.

Another object is to provide a seal which includes a housing for a plurality of stators and a housing for a plurality of rotors, with the stators and rotors being of annular disc form and being interleaved with one another.

A still further object of the invention is to provide a plurality of stators and rotors having interleaved portions and wherein each stator and rotor preferably includes a plurality of lands and grooves or other formations to retard the flow of drilling fluid as it works it way from the inlet chamber of the seal assembly to the outlet at the bottom portion thereof.

A still further object of the invention is to provide a plurality of alternating rotors and stators of annular form in which each includes a seal or packing that prevents leakage between the two sets of stators and rotors.

Another object of the invention is to provide a seal with a housing having a lower end member disposed in opposed relation to another housing member, the two being separated by thrust bearings and/or radial bearings each able to be greased, and maintaining such respective housings in closely spaced apart relation.

A further object is to provide a plurality of stators and rotors, each of which is held in place by a spacer, with the array of spacers being held in fixed position under a compressive load provided by spring means such as Belleville washers, for example.

Another object is to provide a construction wherein the stators are located for anti-rotation and the rotors are located for rotation by means of keyways and locking pins positioned on the outside diameter of the stator disks and the inside diameter of the rotor disks. Belleville washers are used to provide a small preload to the rotor and stator stack and the clamping of the total assembly compresses the stator and rotor spacers to fix the final position, while also providing an adequate seal between the components.

Another object of the invention is to provide radially inner and outer housings, each having a plurality of associated discs, with the inner housing including disks of annular form and defining a cylindrical region on the interior, able to accommodate a high volume of drilling fluid, while passing a small amount of drilling fluid to the annular headspace or chamber between the two housings.

A still further object of the invention is to provide a seal with controlled leakage, which includes an upper connection assembly and a housing attached thereto as well as a lower connection assembly that rotates with the washpipe in the use of the seal assembly.

A further object of the invention is to provide a washpipe seal which may be readily removed and replaced without altering the axial distance between the two connectors, that is, those at the top and the bottom of the assembly.

A still further object of the invention is to provide a system which will hold two parts of the wash pipe seal in snug, non-leaking relation but which can be readily radially removed so that the cartridge can be taken out of the system and replaced with another cartridge, with very little or no difficulty, and no changing of the ultimate distance between the upper and lower pipe flanges or connectors.

Another object is to provide a pair of clamps which can be separated by removing two fasteners on each end and removing the clamps, thereby enabling the cartridge to be removed radially and replaced with very little difficulty.

A still further object is to provide a pair of clamps which act radially and not only permit ease of removal, but also provide inherent alignment and clamping forces which prevent any possible leakage when the clamps are secured.

SUMMARY OF THE INVENTION

These and other objects and advantages of the present invention are achieved in practice by creating an outer housing with plural annular discs, an inner housing of annular form and having plural discs, with drilling fluid passing both inside and outside of the inner housing, with a small proportion of the drilling fluid passing through the inner housing being directed through a labyrinth of discs until it reaches the outlet. The invention also includes a simplified structure permitting ready removal and replacement of the cartridge without altering the position of the master coupling, which remains in a fixed position, having two conduits fastened to it by screw threads or the like on each end.

The manner in which these objects and advantages are achieved will become more clearly apparent when considered in conjunction with a description of the preferred embodiments of the invention and shown in the accompanying drawings in which like reference numbers indicate corresponding parts throughout.

DESCRIPTION OF THE PREFERRED EMBODIMENTS OF THE INVENTION

While the invention may be embodied in a number of different forms, and may employ variations of certain parts, two preferred embodiments of the invention will be described, which include plural rotors and stators that are interleaved with each other and arranged in inner and outer annular housings, and which accommodate a pressure drop from up to 10,000 or more PSI to a much lower level adjacent the outlet.

Figure 2:
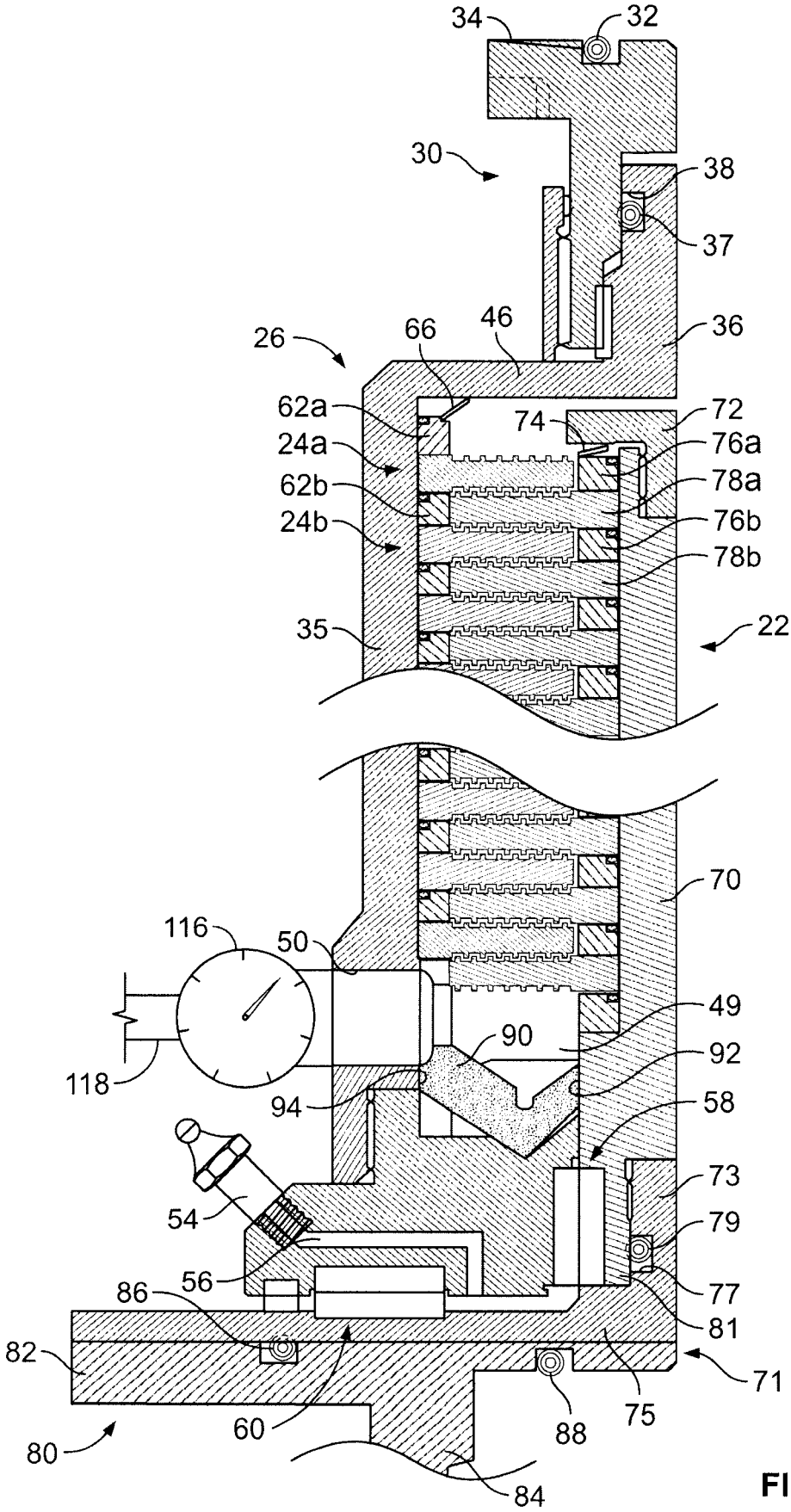
FIG. 2 is an enlarged vertical sectional view through a portion of the apparatus of the present invention and showing one particular preferred arrangement of the stator housing, the rotor housing, plural annular rotors and stators for each housing and other features of the invention.
Figure 3:
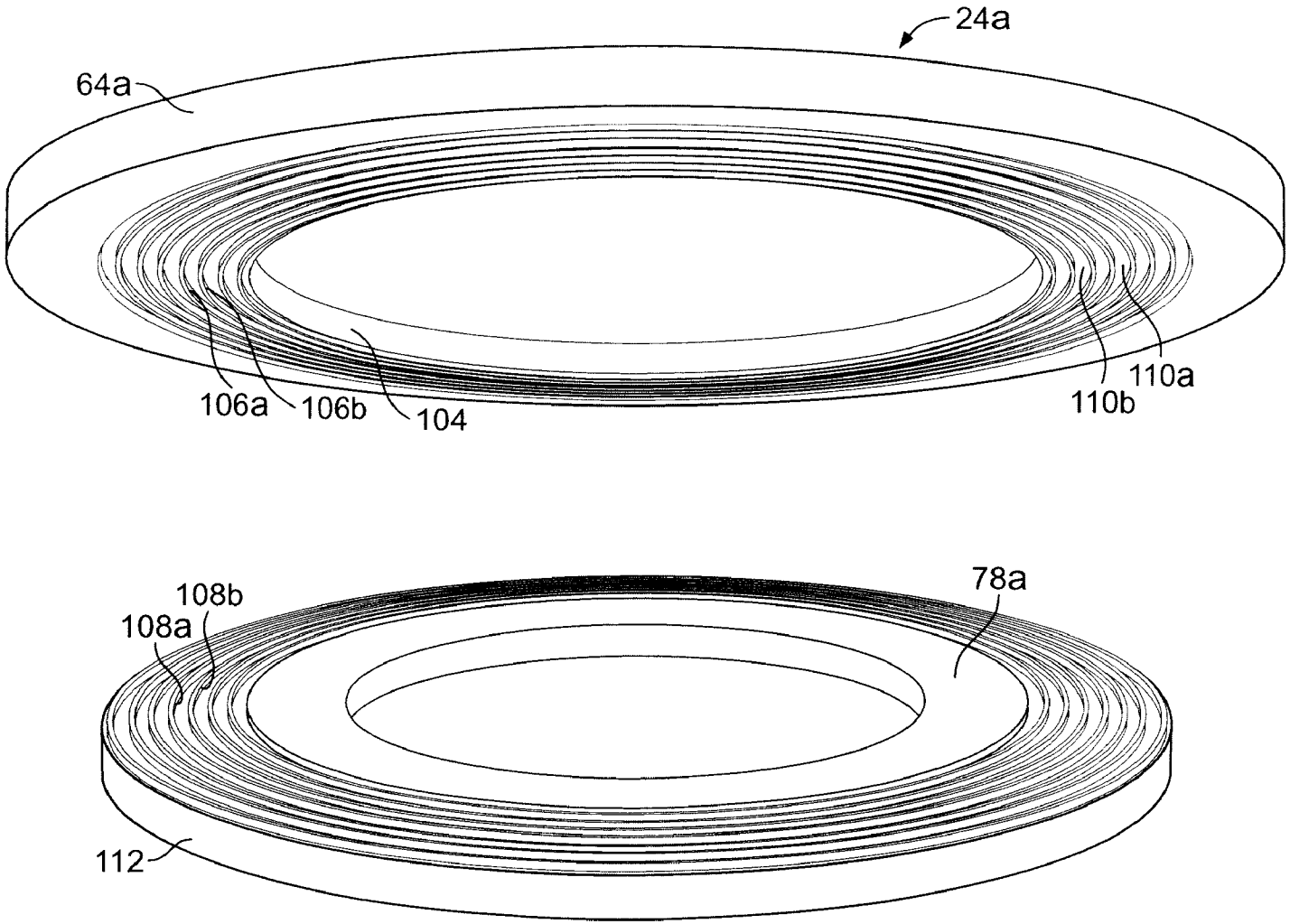
FIG. 3 is an exploded view of one annular stator and one annular rotor and showing them in spaced apart relation.
Figure 4:
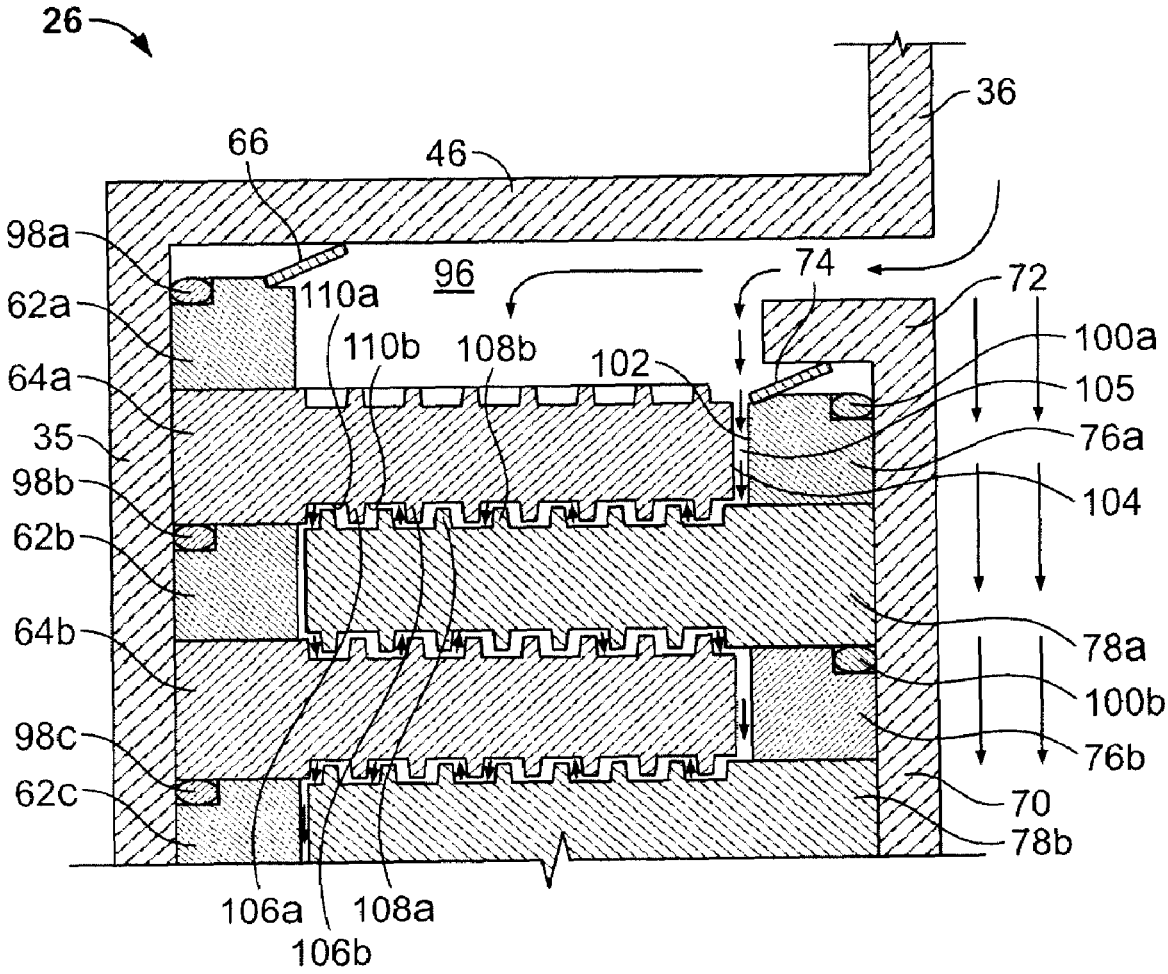
FIG. 4 is a further enlarged vertical sectional view of a portion of the stator/rotor assembly showing the stators and rotors with lands and grooves therein, and including the spacers between the rotor and stators and the seals therefor, and showing the tortuous path undergone by the drilling fluid.

Referring now to the drawings in greater detail, there is shown washpipe seal assembly generally designated 18, and this assembly, as best shown in FIGS. 2–4, includes a stator assembly generally designated 20, and a rotor assembly generally designated 22. The stator assembly 20 includes a plurality of discs generally designated 24*a*, 24*b* received within a housing generally designated 26. This housing 26 is affixed to an upper connection assembly generally designated 30. This assembly 30 includes a radially outer member with an O-ring 32 on its top surface 34. The inner member is preferably in the form of a collar 36 of reduced diameter relative to the housing 26.

An O-ring seal 37 is provided on the collar 36 to seal a joint between the upper connecter assembly 30 and the collar 36. A certain amount of axial freedom of movement or play may take place between the upper connection assembly 30 and the collar 36 on the housing 26. The stator housing generally designated 26 consists of the upper, reduced diameter collar 36, an O-ring groove 38 and a radial flange 46 leading to the outer diameter cylindrical portion 35. Adjacent the bottom of the stator housing 26 is a low pressure annular chamber 49 terminating in an outlet 50.

An enlarged diameter portion generally designated 52 forming a lower continuation of the housing 26 is provided, and this element includes one or more grease fittings 54 connected to suitable passages 56 for grease to lubricate radial and thrust bearing assemblies generally designated 58, 60. These bearings 58, 60 are subject to harsh environmental conditions and are preferably made from a hardened steel material, or tungsten carbide, and the bearings 58, 60 permit rotation between the stator assembly 20 and the rotor assembly 22. Of course, these bearings also permit relative rotation of the rotor and stator and axial and radial guidance of these assemblies 20, 22. Referring again to the spaced apart stators 24*a*, 24*b*, etc., in this embodiment, there is provided an upper spacer unit 62*a* which is fixed relative to the housing 26 by a Belleville washer 66 capable of exerting a strong axial compressive force on the entire stack of spacers 62*a*, 62*b*, etc. and stators 64*a*, 64*b*, etc.

The general arrangement of stacked stators 64*a*, 64*b*, etc. and the arrangement of spacers 62*a*, 62*b*, 62*c*, etc. is the same arrangement as the arrangement of rotors and spacers in the rotor assembly 22. Thus, the washpipe 70 has a radial flange 72 which engages a Belleville washer 74. This Belleville washer develops an axial load on spacers 76*a*, 76*b*, etc. and these spacers 76*a*, 76*b* engage the margin portions of the rotor discs 78*a*, 78*b*, etc.

The lower connection assembly generally designated 71, includes an axial wall 73, a radial wall 75, and a groove 77 accommodating an O-ring 79. The radial bearing 58 is engaged by an extension 81 of the washpipe 70. These portions may be affixed to a rotary member generally designated 80 and having radial and axial flanges 82, 84. These components may include their own O-rings 86, 88 as is customary in the industry.

Referring again to the washpipe 70 and the housing assembly 26, the rotation between these parts 70, 26 (and others fixed respectively with respect to those parts) also requires a seal 90, and this seal or packing 90 engages opposed inner wall portions 92, 94, of the washpipe 70 and the stator 35. This form of "V-packing" 90, however, is unlike prior art seals in that it does not see a large pressure drop and consequently it is able to endure for an extended period of time, in keeping with the life of the remainder of the seal afforded by the rotors and stators.

Referring now to the operation of the controlled leakage seal of the invention and in particular to FIG. 4, an enlarged partial sectional view of the stators, rotors and spacers is shown. Here, spacers 62*a*, 62*b*, etc. hold the stators 64*a*, 64*b* in a relatively fixed position and allow the rotors 78*a*, 78*b* to rotate without radial or axial engagement of their counterparts 64*a*, 64*b*, etc. There is a headspace region 96 provided between the radial flanges 72, 46 of the two housings 26, 70. The spacers 62*a*, 62*b*, etc. are retained in place with the aid of the gaskets or O-rings 98*a*, 98*b*, 98*c*, etc. and the spacers 76*a*, 76*b* are held in position with the aid of O-rings or gaskets 100*a*, 100*b*, etc.

In operation, the headspace region 96 is filled with extremely high pressure drilling fluid, and this drilling fluid is then passed through the passage 105 between the end face portion 102 of the spacer 76*a* and the end face portion 104 of the stator 64*a*. It will be noted that each of the stators 64*a*, 64*b*, etc. has a plurality of lands or teeth 106*a*, 106*b*, etc. disposed in offset relation to the lands 108*a*, 108*b*, etc. on the rotor 78*a*. Grooves 110*a*, 110*b* are disposed in an opposed relation to the lands 108*a*, 108*b*, etc.

With the very small space 105 between the end faces 102, 104 being duplicated all along the axial and radial path between the stators 64*a*, 64*b*, the rotors 78*a*, 78*b*, etc., a tortuous path of leakage is provided for the drilling fluid as it makes its way to the annular chamber 49. This scheme of extremely narrow passages, both axial and radial, when repeated from 16 to 20 times, has the effect of gradually lowering the pressure from the 7,000 to 10,000 PSI to a greatly reduced pressure which will appear in the lower chamber 49. From there, the drilling fluid optionally passes through a flow meter 116, and from there to a conduit 118 wherefrom it may be returned to the supply of drilling fluid for reuse.

Figure 5:
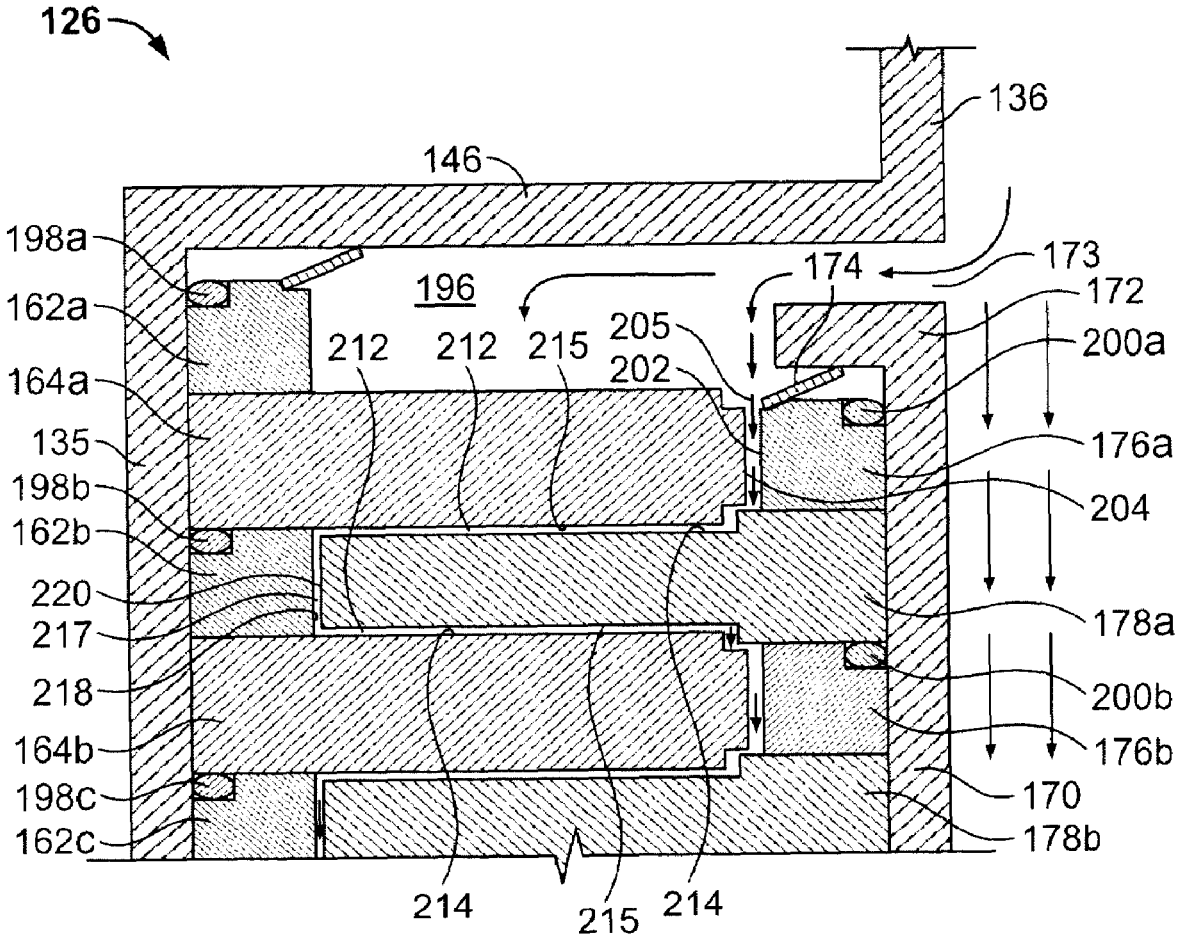
FIG. 5 is a view similar to FIG. 4, only showing the stators and rotors without the lands and grooves.

Referring now to FIG. 5 and another embodiment of the invention, an alternate construction of the rotor and stator disks is shown. In this embodiment, the stator consists of a reduced diameter collar 136, a radial flange 146, and a cylindrical axial flange 135. Disposed inside this cylindrical shell 135 is a spacer 162*a*, sealed by an o-ring 198*a*. Several additional spacers 162*b*, 162*c*, etc. are stacked inside this cylindrical shell 135, and the additional spacers 162*b*, 162*c* each include additional o-rings 198*b* and 198*c*. The head space 196 lying between the radial flange 172 of the inner cylinder or washpipe 170, and the radial flange 146 of the cylindrical shell 135 provides a passage 173 for drilling fluid entering the head space 196.

A compressive force is maintained by Belleville washer 166 acting on the spacer 162*a* and all of the components in axial alignment therewith. A Belleville washer 174 bears on the inner spacer 176*a*, 176*b* and on the disks 178*a*, 178*b* entrapped between them. O-rings 200*a*, 200*b* seal the spaces 176*a*, 176*b*, etc. The only difference in operation between embodiment of FIG. 4 and that of FIG. 5 is that of the configuration of the rotors/stators of the invention.

For example, the end face 202 of the spacer 176*a* and the end face 204 of the stator designated 164*a* lie in opposed relation with a small clearance 205, such as 0.005 to 0.060 inches, by way of example, between them. The horizontal space 215 between the stator 164*a* and the rotor 178*a* is defined by the top and bottom faces 212, 214 of the stator 164*a* and the rotor 178*a*. The drilling fluid passes in the space 215 between these narrow faces 202, 204 and into the space 217 between surfaces between the surfaces 218, 220, and so on until the drilling fluid has reached the bottom of the chamber 49 at the lower end of the washpipe 170.

Consequently, the region 196 is filled with extremely highly pressurized drilling fluid, most of which travels down inside the washpipe 170. However, a small amount of this drilling fluid is forced into to the passage 215, 217, etc. between the end portions and surface portions of the rotors and stators.

Referring now to the stators the rotors and the means for keeping them apart, the spacers shown in the drawings are the preferred method of doing this. However it is not the only method of keeping these stators or rotors apart, since this can be done by merely forming an extension of enlarged width on the end of each rotor or stator, thereby imparting an L shape to the inboard and outboard of the stators or rotors. The O-rings such as the O-rings 198*a*, 198*b*, the 200*a*, 200*b*, etc. may be replaced with any suitable kind of packing, preferably a so-called block V or the like.

The Belleville washer is shown as being compact and having a high spring rate which is desirable in most cases. However, a wave-type spring or washer could be used or other means having a strong spring rate to hold these elements together.

The invention has been described showing of lands and grooves facing each other in one embodiment, and a plain ungrooved embodiment as another choice. However, it is possible to have one face grooved or the like or to have lands in the other side could be merely a planar surface. The preferred method are the tongue and groove, or lands and grooves, method illustrated or the plain, unadorned faces. Regarding the size of this space, it has been found that the most effective space depends upon the viscosity and pressure of the drilling mud, but having the lands and grooves with 0.005 to 0.050 is preferred. Some other values may be used if desired. The packing 90 has been illustrated as the most economical and effective method of creating a seal between the relatively low pressures involved at the bottom of the chamber. Needless to say, however, another type of seal could be used in this application.

Another entirely different method could use the apparatus of the present invention with no change or with only a slight change in the apparatus. In this case, the spaces between the rotors and the stators could be filled with grease up to approaching, or even meeting, the headspace 96. In this instance, the grease would have to be injected into the apparatus while there were no countervailing high pressure from the drilling mud. Once this space was filled entirely with grease, the seal would otherwise, function as designed, with the drilling and pressure being counteracted with the resistance to movement of the grease.

Preferably, the two housings, the stators and the rotors and other parts are made from tungsten carbide or similar material, since these components see the highest pressure drilling fluid. Other components use an oil field grade steel. The o-rings and the block V or similar type seals are made from synthetic rubber or other known material.

Referring now to the structure for reducing or eliminating maintenance problems, FIGS. 6–9 show a slightly modified form of the invention but one which greatly simplifies the removal of the entire cartridge shown in FIGS. 6–9. By cartridge is meant a removable part which includes the outer housing and the inner rotor and all their associated elements.

Figure 6:
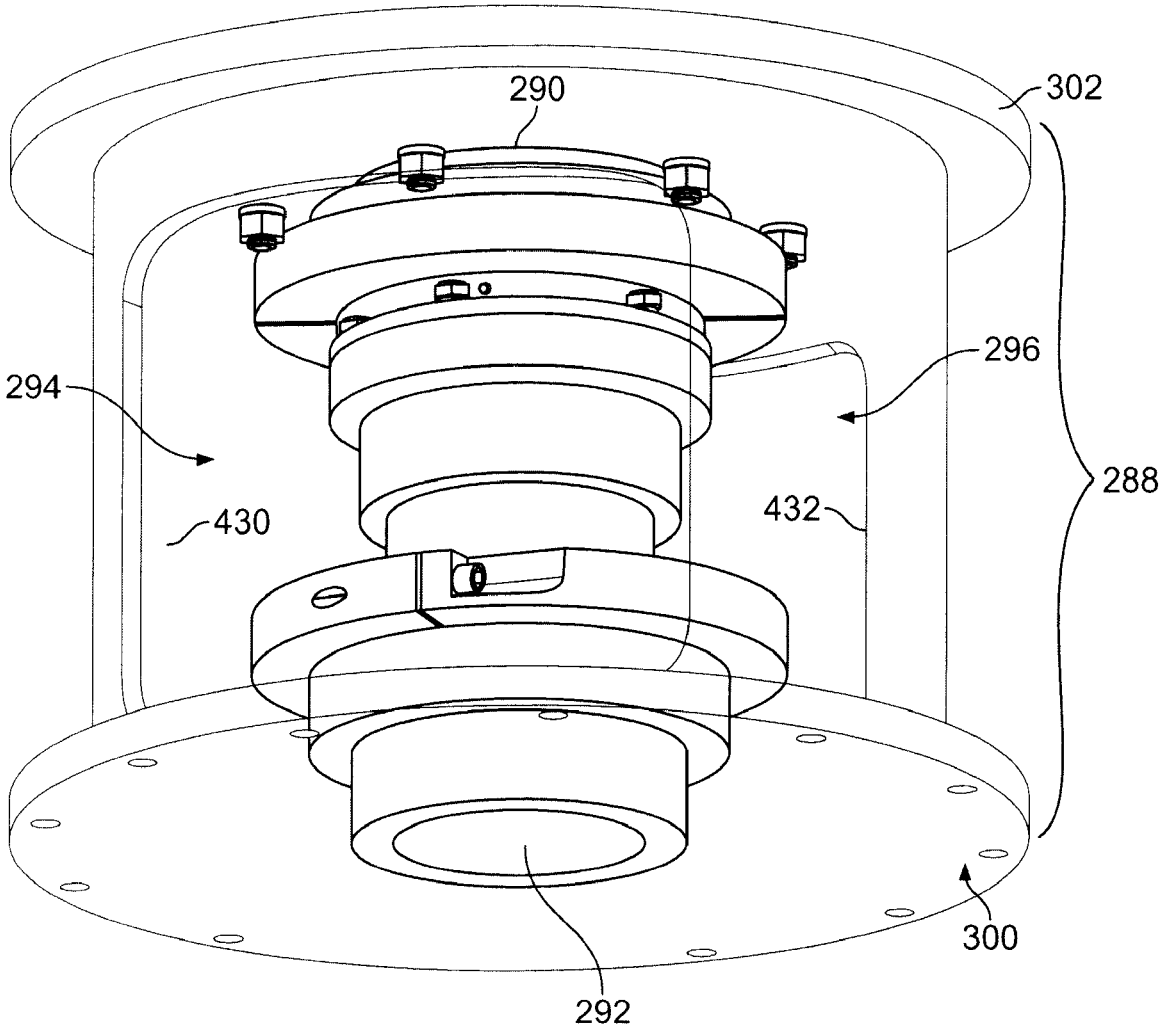
FIG. 6 is a perspective view of the cartridge holder of the present invention, showing in lighter lines the master coupling and the passages through which the removable clamp and the cartridge may be removed and replaced.
Figure 7:
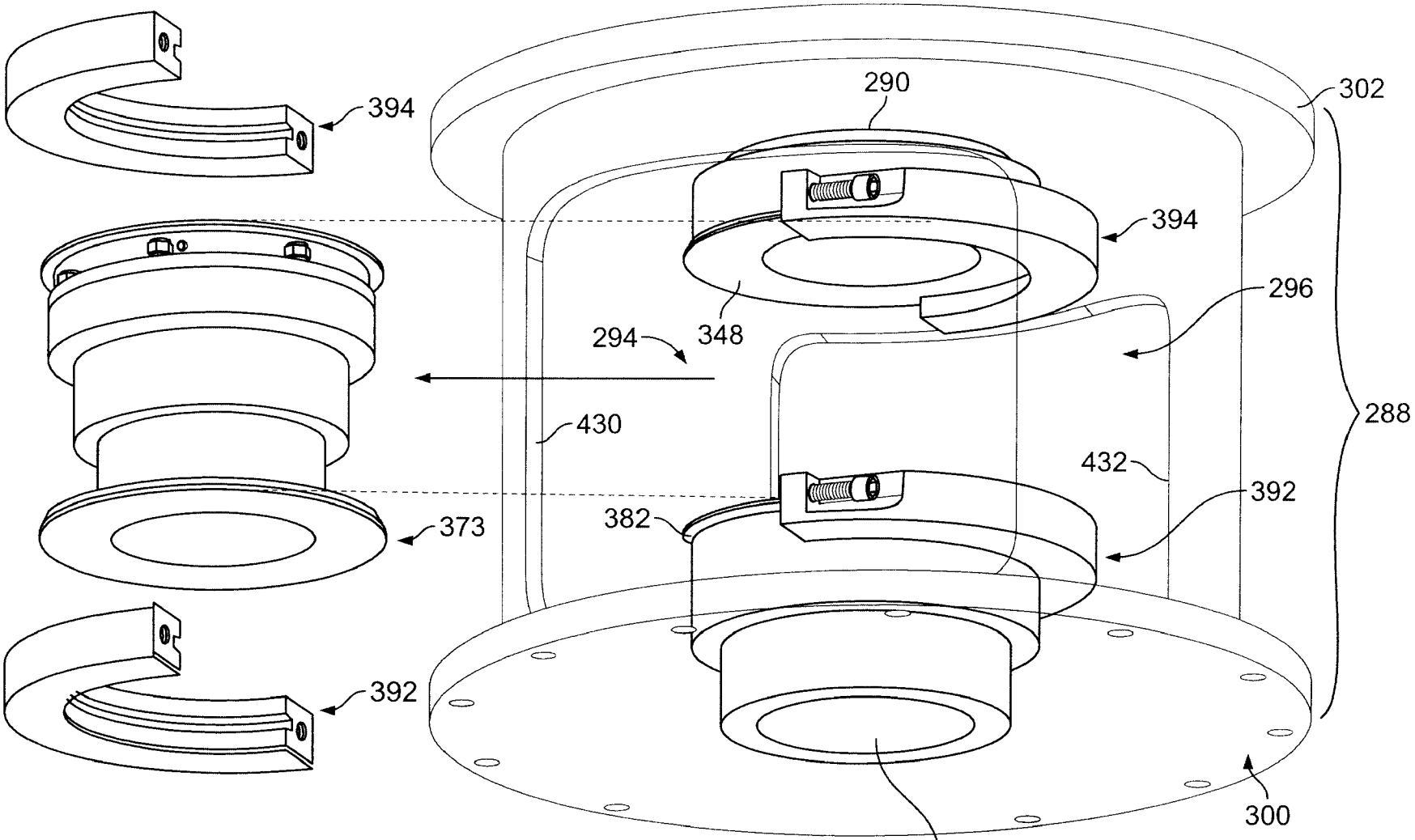
FIG. 7 is a perspective view showing in lighter lines the master coupling and showing the cartridge in the process of being replaced and/or renewed.
Figure 8:
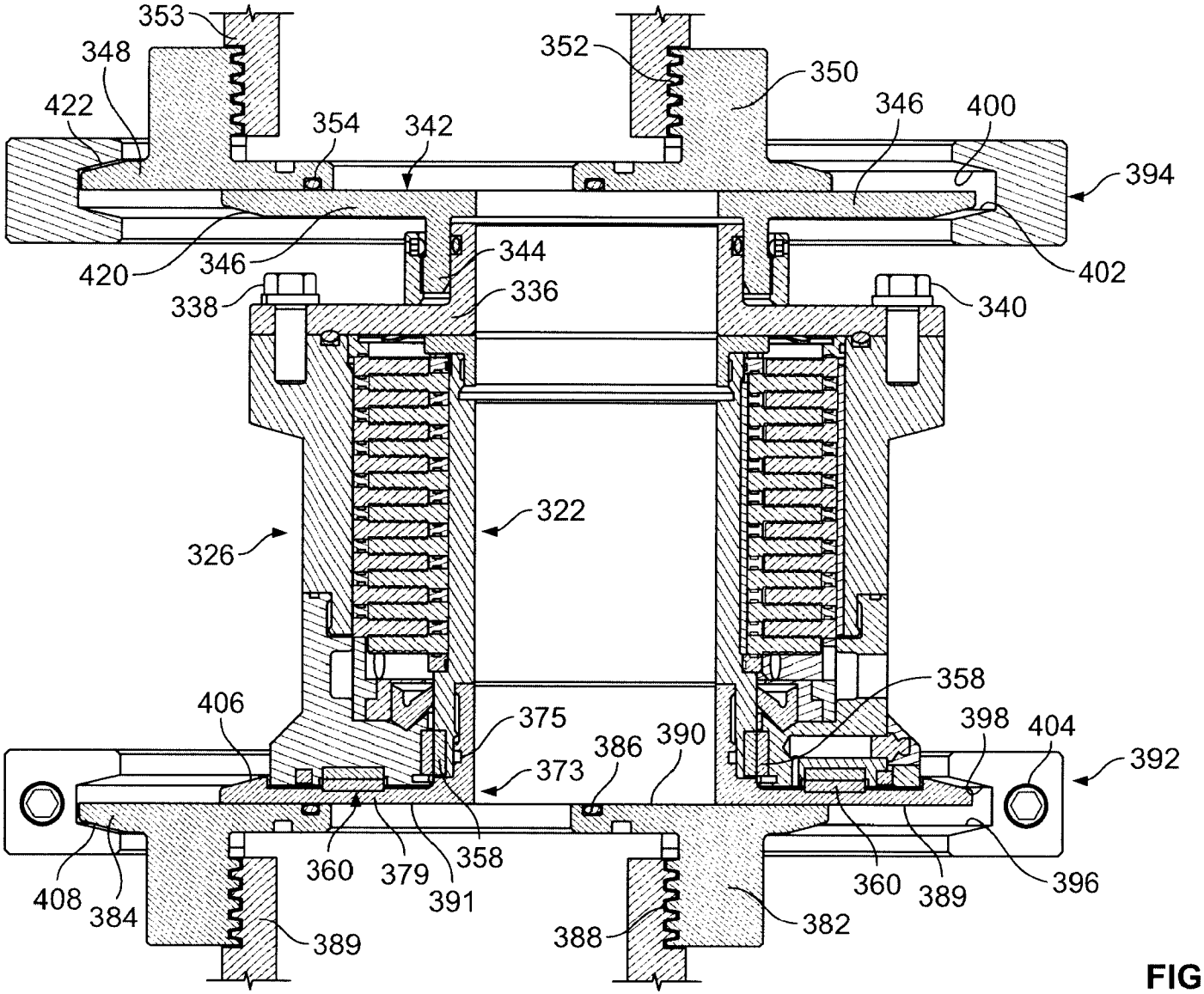
FIG. 8 is a vertical sectional view showing the cartridge in the process of being removed and showing the two positions of the clamp holding the cartridge in position.

Thus, referring again to FIGS. 6–9, there is shown in lighter lines, the master coupling 288 which secures the upper and lower passages 290, 292 together in fixed axial relation and the master coupling 288 includes two enlarged openings 294, 296. In FIGS. 6–8 there is shown a large lower flange generally designated 300 and an equally large upper flange generally designated 302. It will be seen that there is one outer housing generally designated 326 and one inner, rotary housing generally designated 322. These elements are essentially the same as their counterparts in FIGS. 1 and 2. The main difference between these embodiments is that the upper collar 336 is formed separately and attached as by fasteners 338, 340 etc. to the housing 326.

The upper fixed collar 336 is kept in snug relation to the upper flange generally designated 342. This flange 342 has a downwardly extending, cylindrical portion 344 and a wide flange portion 346. The portion 346 has a top surface which is planar, and mates in generally fluid-tight position with an upper flange 348 which has a cylindrical portion 350 attached in leak-proof position by threads or the like 352 to the upper inlet portion 353. An O-ring 354 ensures a seal between the flange 348 and the flange 346 when the flanges 346, 348 are in facing relation and in snug engagements as will be described.

Referring now to the lower collar generally designated 373, this unit is similar to its counterpart in that an upright cylindrical portion 375 is provided and a generally horizontal flange 379 is held in that position as by bearings 358, 360 to enable it to rotate relative to the lower portion 382. The lower portion 382 is generally similar to its upper counterpart in FIG. 8, and this includes an O-ring 386 which engages the face 389 of the flange 379. The portion 382 includes, in addition to the O-ring 386, a horizontally extending flange 384 which is fastened by threads or the like 388 to a fixture 389 which is the uppermost portion of the drill string. The surfaces 389, 391 of the opposing flanges are ultimately made relatively mechanically tight and make a substantially fluid-tight connection.

A novel feature of the invention includes the two clamps generally designated 392 and 394. Each of these clamps each has a pair of tapered inner surfaces 396, 398, 400, 402 as well as screw receiving bores 404. The tapered marginal mating surfaces 406, 408 on one clamp are received within the surfaces 396, 398. Accordingly, when the clamp 392 has been tightened, these surfaces 406, 408 remain extremely secure because their taper matches that of the surfaces 396, 398 on the clamp. There are counterpart surfaces for 420, 422 which are ultimately engaged by surfaces 400, 402 on the clamp 394, thus holding the two flange 346, 348 together.

When the clamps 392, 394 are removed by loosening the Allen head fasteners 403, the two halves come apart, and their construction allows the housings to slip past each other and out either one of the openings 294, 296 defined by the sidewalls 430, 432 in the master coupling 288.

Figure 9:
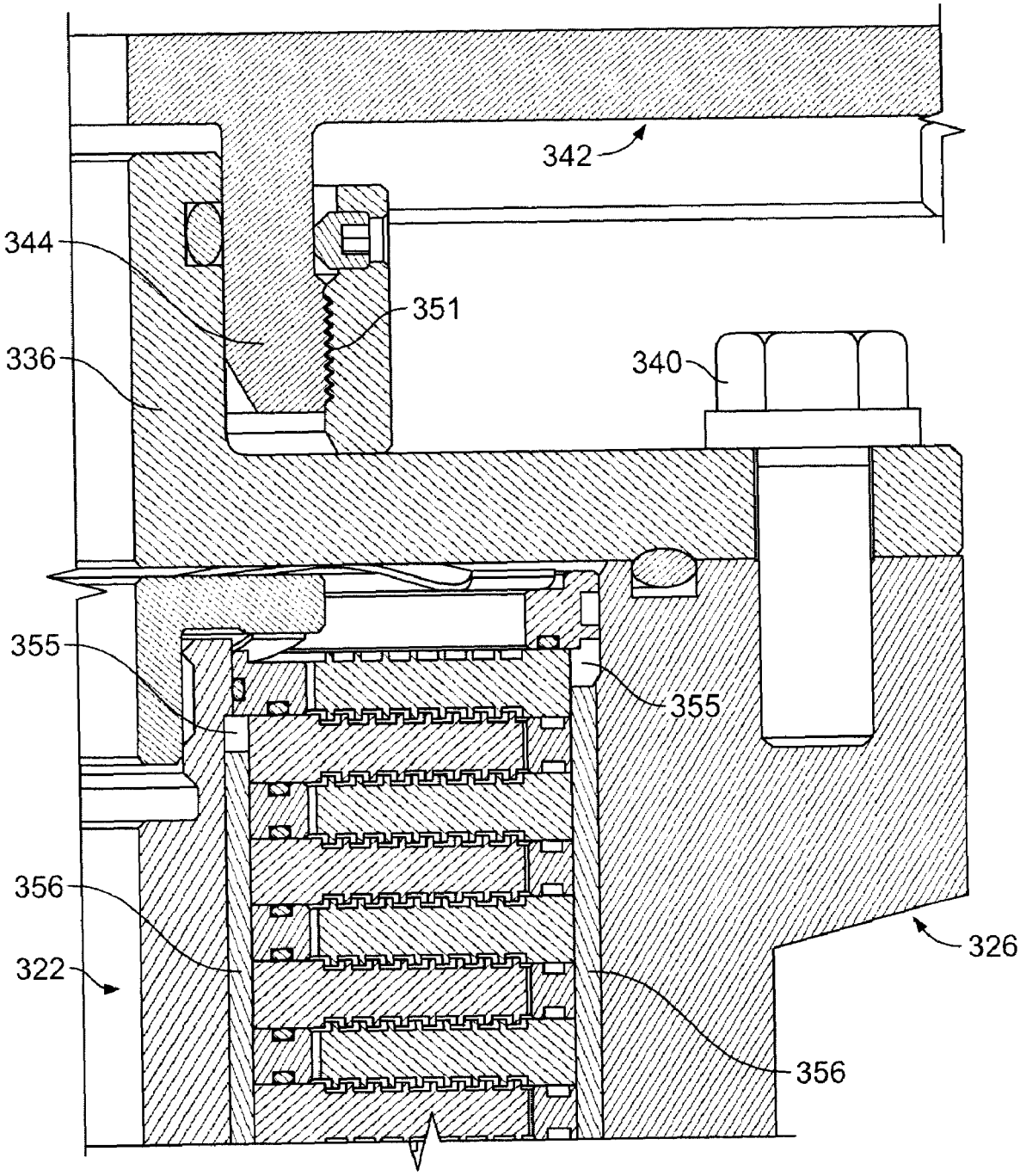
FIG. 9 is a further enlarged view of a portion of FIG. 8, showing several details of construction and schematically showing the keyways and locking pins o the invention, and the threaded collar allowing release of the flanges.

Referring now in particular to FIG. 9, it is shown that, in a preferred construction, when it is time to release the clamps and remove the cartridge, a certain amount of axial play between the upper portion fixed collar 336 and the downwardly extending cylindrical portion 344 may be gained by unscrewing the threaded collar 351. This lowers the cylindrical portion 344 and the flange 342 downwardly and enables the lower flange 342 to be more easily separated from the upper flange 348.

Figure 1:
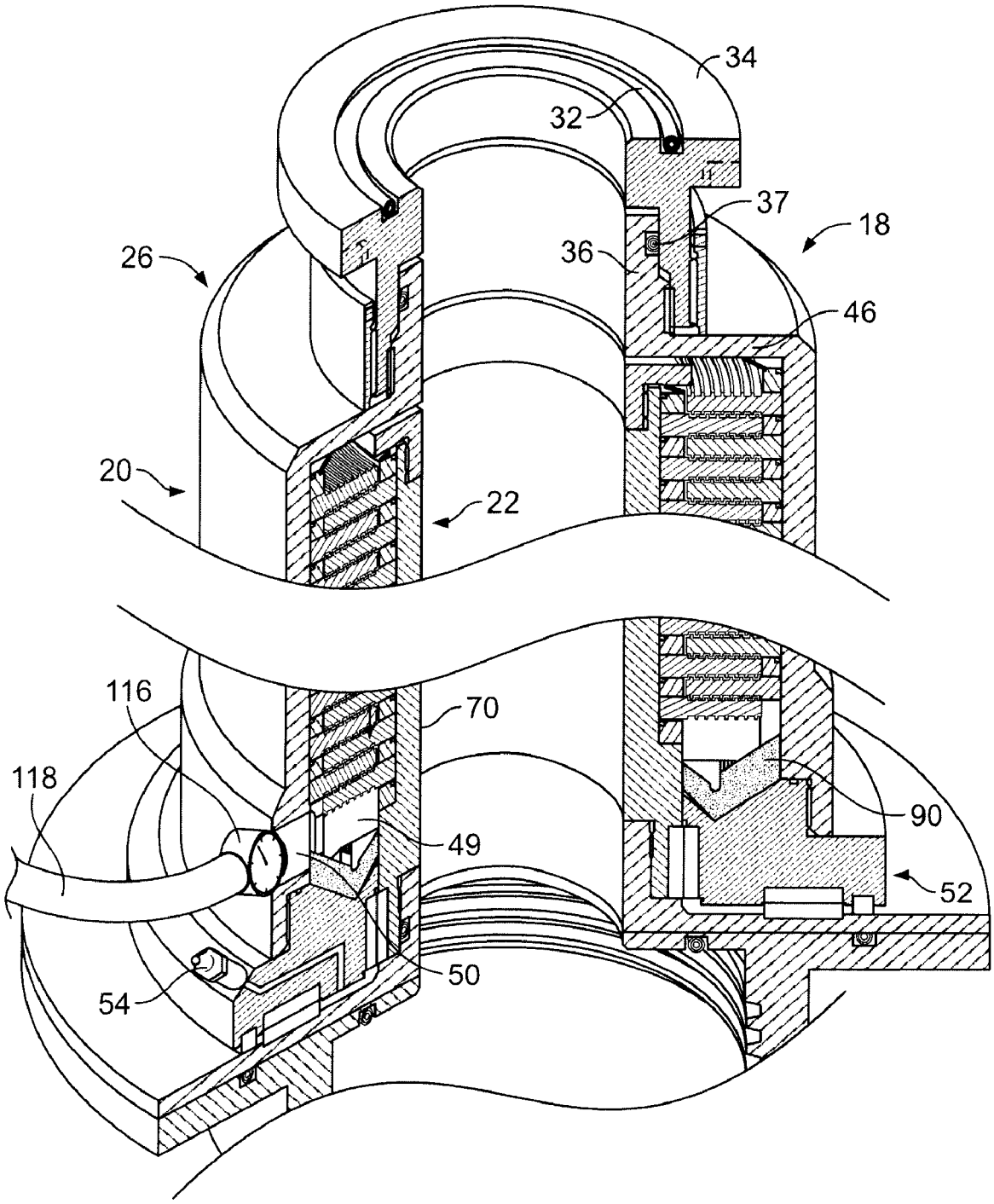
FIG. 1 is a perspective view showing several important features of the present invention including showing the upper connection assembly, the lower connection assembly and the arrangement of the annular stator and rotor discs in interleaved relation.

Thereupon, a new cartridge containing the labyrinth and the elements described in connection with FIGS. 1 and 2, for example, may readily be replaced, simply by slipping the entire cartridge into place, whereupon the flanges will be engaged by the clamps 392, 394 and tightened down. The O-rings 354, ensure a tight seal between parts which do not undergo relative rotation.

FIG. 9 also schematically shows that there are keyways 355 and locking pins or blades 356 in place so that the rotor disks and the stators remain fixed with their respective housing portions 322, 326.

It will thus be seen that the present invention provides a novel controlled leakage seal assembly having a number of advantages and characteristics, including those herein pointed out and others which are inherent in the invention.

The inventioned claimed is:

1. A seal assembly for controlling leakage of drilling fluid between a first stationary portion adapted to be connected in substantially fluid-tight relation to a source of drilling fluid and a second portion adapted to be connected in substantially fluid-tight relation to a rotary portion including a washpipe and a drill string, said first seal portion including a first housing and stack of radially inwardly extending, spaced apart annular stators and a second seal portion including a second housing and stack of spaced apart radially outwardly extending annular rotors, said stators and said rotors being interleaved with one another and being axially spaced apart from one another by a working clearance, said stators and said rotors combining to define an elongated radially and axially extending tortuous path from an inlet region at one axial end of said stack of stators and rotors for receiving drilling fluid confined at high pressure and directing said fluid along said tortuous path to an outlet region at the other axial end of said stack of stators and rotors, said seal assembly permitting said washpipe and said first and second housings to rotate relative to each other in substantially fluid-tight relation except for said drilling fluid passing along said tortuous path between said stacks of rotors and stators, and allowing said drilling fluid to enter said outlet region at greatly reduced pressure.

2. A seal assembly as defined in claim 1, wherein each of said stators and each of said rotors includes a large plurality of radially closely spaced apart, circumferentially extending lands and grooves.

3. A seal assembly as defined in claim 1 wherein said stators and said rotors having working faces that are spaced apart by a working clearance of from about 0.005 to about 0.090 inches.

4. A seal assembly as defined in claim 1 wherein said stators and said rotors are held in a said interleaved position by spacers lying between the radially outer margins of said stators and lying between the inner margins of said rotors.

5. A seal assembly as defined in claim 4 wherein said spacers are confined by means for exerting a compressive force thereon.

6. A seal assembly as defined in claim 5 wherein said means for exerting a compressive force includes Belleville washers.

7. A seal assembly as defined in claim 4 wherein said stators and said rotors include close radial spaces between them, thereby providing a portion of said tortuous path.

8. A seal assembly as defined in claim 1 wherein said outlet region for receiving said drilling fluid at said greatly reduced pressure is an annular chamber.

9. A seal assembly as defined in claim 1 wherein said seal assembly further includes means at said outlet region for directing said drilling fluid toward a return path, and a flow meter disposed in said return path.

10. A seal assembly as defined in claim 1 wherein said upper and lower portions are held apart by means including a sleeve having at least one opening therein to permit said seal assembly to be removed radially from said stationary position.

11. A seal assembly as defined in claim 1 wherein said seal assembly has means permitting said first and second housings to rotate relative to each other, said means also including means permitting said first and second housings to be removed and replaced as a unit in a radial direction without disturbing the fluid-tight connections between the source of said drilling fluid and said drill string.

12. A seal assembly as defined in claim 1 wherein said first stationary portion for attachment to a source of drilling fluid includes a first radial flange, and a second cooperating flange extending radially from said first portion, and wherein said rotary portion includes a third radial flange adapted to mate in fluid-tight relation with a fourth flange, said first and second flanges having a first releasable clamp holding them snugly together and said third and fourth flanges having a second releasable clamp holding them snugly together.

13. A seal assembly as defined in claim 1 which includes a first radial flange extending from said source of drilling fluid and a second radial flange extending from said first stationary portion, and a third radial flange extending from said rotary portion and a fourth radial flange extending from said fixture associated with said

14. A seal assembly as defined in claim 1 in which said seal assembly is held in an axially stationary position by upper and lower members and a sleeve holding said upper and lower members apart in a fixed relation, said sleeve having at least one opening therein to permit said seal assembly to be removed radially from said stationary position.

15. A seal assembly for controlling leakage of drilling fluid between a first stationary portion connected in substantially fluid-tight relation to a source of drilling fluid and a second portion connected in substantially fluid-tight relation to a rotary portion including a washpipe and a drill string, said first seal portion including a first pair of flanges and a first pair of clamps, a first housing and a stack of radially inwardly extending, spaced apart annular stators in the form of thin disks, and a second seal portion including a second pair of flanges and second pair of clamps, a second housing and stack of spaced apart, radially outwardly extending annular rotors in the form of thin disks, said stators and said rotors being interleaved with one another and being axially and radially spaced apart from one another by a working clearance, of from about 0.005 inches to about 0.090 inches, the faces and end portions of said stators and said rotors combining to define an elongated, radially and axially extending tortuous path from an inlet region at one axial end of said stack of stators and rotors for receiving drilling fluid confined at high pressure and directing said fluid along said tortuous path to an outlet region at the other axial end of said stack of stators and rotors, said seal assembly permitting said washpipe and said first and second housings to rotate relative to each other in substantially fluid-tight relation except for said drilling fluid passing along said tortuous path between said stacks of rotors and stators, and allowing said drilling fluid to enter said outlet region at greatly reduced pressure, said flanges and said clamps being constructed and arranged for ready release.

16. A seal assembly as defined in claim 15 wherein at least one group of said rotors and stators includes radially extending axially facing surfaces having plural land and groove formations thereon to retard the flow of drilling fluid through said seal.

17. An attachment system including first radial flange for attachment in fluid-tight relation to a source of drilling fluid, a fourth radial flange for fluid-tight attachment to a rotary drill string, and a cartridge lying in use between said first and fourth flanges, said cartridge having second and third radial flanges attached respectively to a fixed portion and a rotary portion, said fixed and rotary portion having interleaved discs creating a tortuous path of fluid drilling flow between them, said first and second flanges and said third and fourth flanges being releasably clamped together.

18. An apparatus for lowering the pressure of drilling fluid between a fluid inlet and a fluid outlet, said apparatus comprising, in combination, a stationary portion adapted to be connected in substantially fluid-tight relation to a source of drilling fluid, a rotary portion adapted to be connected in substantially fluid-tight relation to an outlet for confining drilling fluid under pressure, a holder for attaching said inlet and said outlet in fixed position, and an opening in said holder, pair of flanges on said inlet side, a pair of flanges on said outlet side, a split-body clamp holding each pair of flanges releasably together in substantially fluid-tight relation, whereby said clamps may be removed to permit said stationary portion and said rotary portion to be removed radially through said opening without causing said holder to be moved or said fluid tight connections to be compromised.

* * * * *